US006205800B1

(12) United States Patent
Topper et al.

(10) Patent No.: US 6,205,800 B1
(45) Date of Patent: Mar. 27, 2001

(54) MICROPROCESSOR CONTROLLED DEMAND DEFROST FOR A COOLED ENCLOSURE

(75) Inventors: Robert Topper, Heber Springs; Robert Gilliom, Wooster; Joseph Sanders; Jason Breland, both of Conway, all of AR (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/310,452

(22) Filed: May 12, 1999

(51) Int. Cl.[7] ..... F25B 47/02
(52) U.S. Cl. ..... 62/156; 62/128; 62/155
(58) Field of Search ..... 62/156, 155, 234, 62/140, 128

(56) References Cited

U.S. PATENT DOCUMENTS

| | | | | |
|---|---|---|---|---|
| 3,681,933 | * | 8/1972 | Check, Jr. | 62/156 |
| 3,839,878 | * | 10/1974 | Tilmanis | 62/156 X |
| 4,156,350 | | 5/1979 | Elliott et al. | 62/80 |
| 4,173,871 | | 11/1979 | Brooks | 62/80 |
| 4,251,988 | | 2/1981 | Allard et al. | 62/80 |
| 4,400,949 | | 8/1983 | Kinoshita et al. | 62/140 |
| 4,406,133 | | 9/1983 | Saunders et al. | 62/80 |
| 4,474,024 | | 10/1984 | Eplett et al. | 62/140 |
| 4,573,326 | | 3/1986 | Sulfstede et al. | 62/156 |
| 4,850,204 | | 7/1989 | Bos et al. | 62/234 |
| 4,884,414 | | 12/1989 | Bos | 62/156 |
| 4,916,912 | | 4/1990 | Levine et al. | 62/80 |
| 4,993,233 | | 2/1991 | Borton et al. | 62/155 |
| 5,179,841 | | 1/1993 | Phillips et al. | 62/81 |
| 5,528,908 | | 6/1996 | Bahel et al. | 62/81 |
| 5,666,816 | | 9/1997 | Jeong et al. | 62/154 |
| 5,765,382 | | 6/1998 | Manning et al. | 62/154 |

FOREIGN PATENT DOCUMENTS 0 505 315 A1 9/1992 (EP) .

* cited by examiner

*Primary Examiner*—Harry B. Tanner
(74) *Attorney, Agent, or Firm*—Pearne & Gordon LLP

(57) ABSTRACT

A refrigerated device having a cooled enclosure and an evaporator through which refrigerant is circulated. An air temperature sensor adapted to generate an air temperature signal indicative of air temperature within the enclosure is provided. A refrigerant temperature sensor adapted to generate a refrigerant temperature signal indicative of refrigerant temperature is provided. A programmable controller adapted to compare the air temperature signal and the refrigerant temperature signal to calculate a difference between the air temperature and the refrigerant temperature is provided. The controller initiates a defrost routine for removing condensate from the evaporator if the difference between the air temperature and the refrigerant temperature is greater or equal to a defrost threshold. Also disclosed are methods for defrosting a refrigerated device and for detecting condensate accumulation.

24 Claims, 4 Drawing Sheets

MICROPROCESSOR CONTROLLED DEMAND DEFROST FOR A COOLED ENCLOSURE

BACKGROUND OF THE INVENTION

The present invention generally relates to refrigerated devices having cooled enclosures such as refrigerators and/or freezers. More specifically, the present invention relates to detecting an accumulation of ice on an evaporator associated with the refrigerated device and carrying out a demand defrost operation to remove the ice.

Commercial and domestic refrigerators and freezers are provided with a refrigeration unit for cooling. The refrigeration unit typically has a compressor driven by a compressor motor, a condenser and an evaporator. As the refrigeration unit operates, water vapor condenses on the evaporator and results in the build-up of frost and ice on the evaporator. The build-up of frost and ice on the evaporator results in diminished air flow through the evaporator and a reduction in the ability of the refrigeration unit to cool the air within the refrigerator or freezer. To enhance the efficiency of refrigerators and lower their power consumption, many refrigerators are designed to periodically defrost the evaporator. Defrost devices, such as heaters, are often used to hasten the defrost operation. Also known are refrigerators that defrost on demand by sensing an accumulation of ice and, in response, initiate a defrost operation. Examples of such refrigerators are described in U.S. Pat. Nos. 4,850,204, 4,884,414, 4,916,912, 4,993,233 and 5,666,816, each of which are wholly incorporated herein by reference.

However, the prior art refrigerators fail to teach a demand defrost scheme that uses temperature measurements that are directly related to heat transfer principles as a basis for determining condensate accumulation. Accordingly, the prior art refrigerators have inherent inefficiencies. The prior are refrigerators are also burdened with overly complex algorithms and timing considerations.

SUMMARY OF THE INVENTION

The present invention overcomes these disadvantages by providing a refrigerated device that has a cooled enclosure and an evaporator. The evaporator has refrigerant circulated therethrough. An air temperature sensor adapted to generate an air temperature signal indicative of air temperature within the enclosure is provided. A refrigerant temperature sensor adapted to generate a refrigerant temperature signal indicative of refrigerant temperature is provided. A programmable controller adapted to compare the air temperature signal and the refrigerant temperature signal to calculate a difference between the air temperature and the refrigerant temperature is provided. The controller initiates a defrost routine for removing condensate from the evaporator if the difference between the air temperature and the refrigerant temperature is greater or equal to a defrost threshold.

In accordance with other aspects of the invention, a method of defrosting a refrigerated device and a method of detecting condensate accumulation are disclosed.

BRIEF DESCRIPTION OF THE DRAWING

These and further features of the present invention will be apparent with reference to the following description and drawings, wherein.

DETAILED DESCRIPTION OF THE INVENTION

Figure 1:
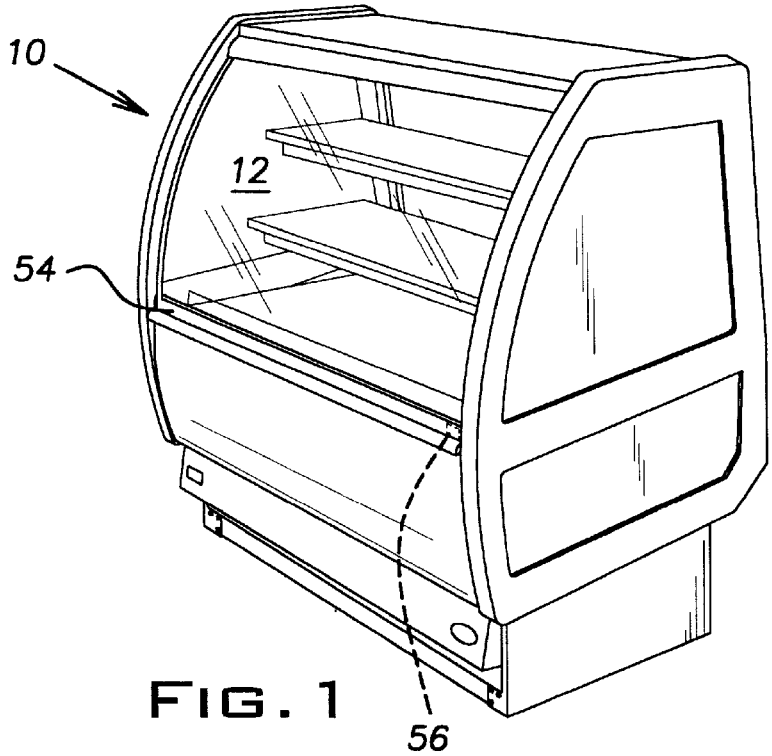
FIG. 1 is a perspective view of a refrigerator according to the present invention.

In the detailed description which follows, identical components have been given the same reference numerals, and, in order to clearly and concisely illustrate the present invention, certain features may be shown in somewhat schematic form.

FIG. 1 illustrates a refrigerated device. The illustrated example of the refrigerated device is a commercial refrigerator 10 and the description of the demand defrost scheme that follows will be directed to the commercial refrigerator 10. However, one skilled in the art will appreciate that the invention can be adapted for use in other refrigerated devices, such as a commercial refrigerator/freezer combination, a stand-alone commercial freezer, or a domestic refrigerator/freezer. The refrigerator 10 is provided with a refrigerated compartment, or cooled enclosure 12, for the storage of items to be kept cold.

Figure 2:
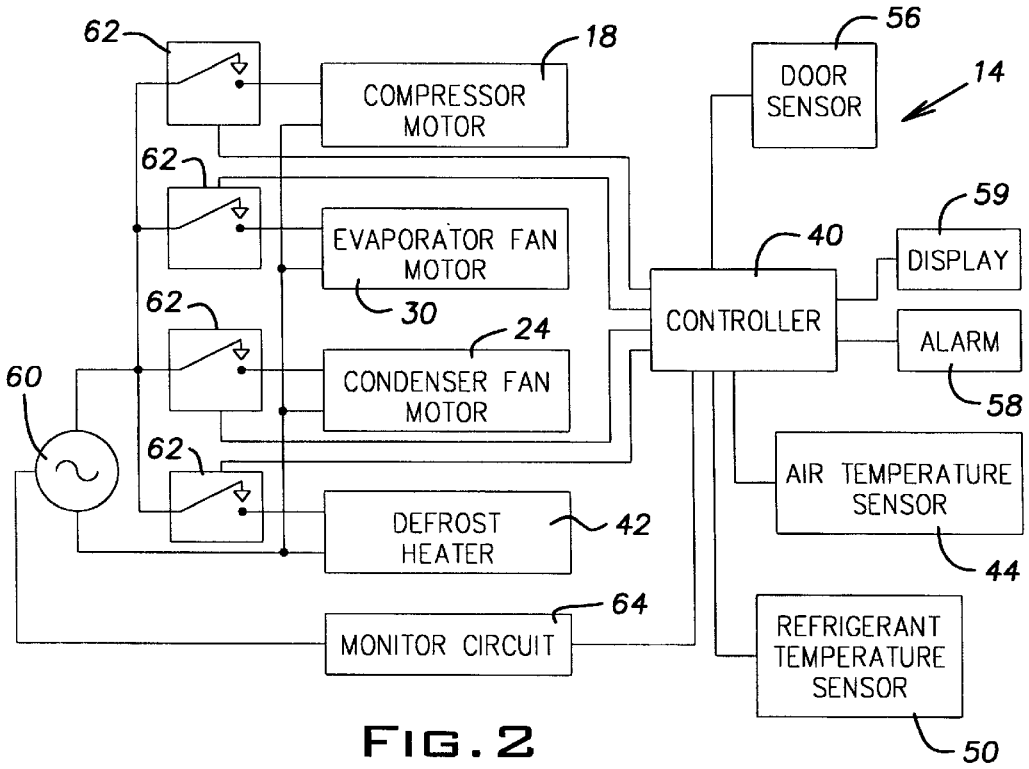
FIG. 2 is an electrical block diagram of a refrigeration unit according to the present invention.
Figure 3:
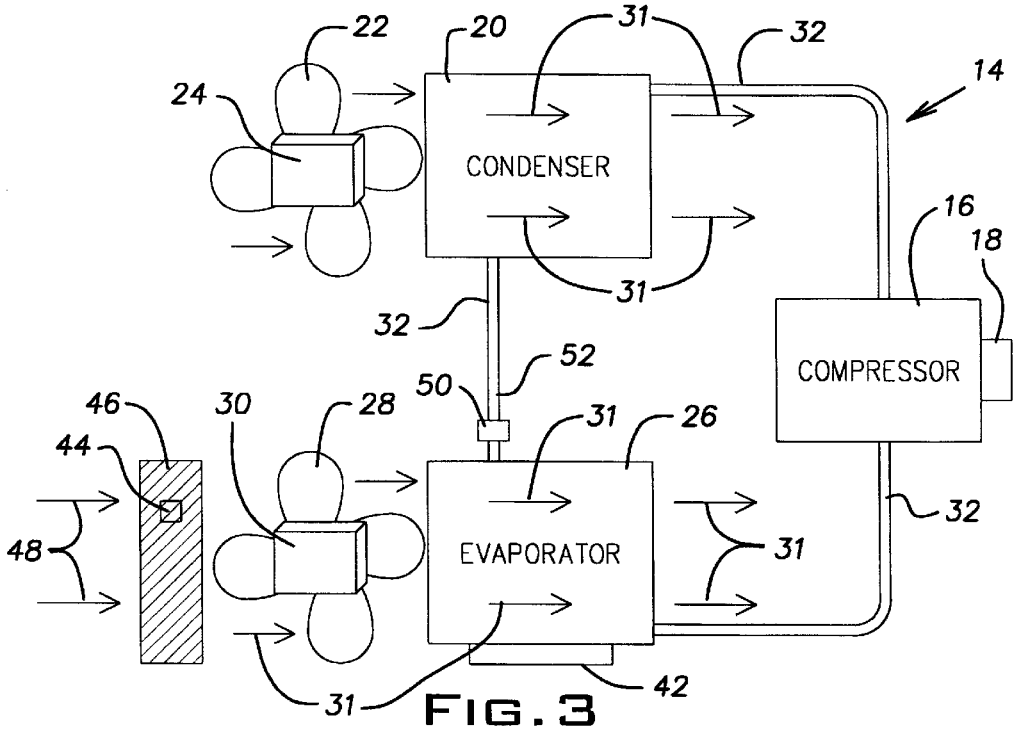
FIG. 3 is a mechanical block diagram of the refrigeration unit according to the present invention.

With additional reference to FIGS. 2 and 3, a refrigeration unit 14 for cooling the enclosure 12 is shown. FIG. 2 is an electrical block diagram of the refrigeration unit 14 and FIG. 3 is a mechanical block diagram of the refrigeration unit 14. As is well known in the art, the refrigeration unit 14 has a compressor 16 driven by a compressor motor 18, a condenser 20, a condenser fan 22 driven by a condenser fan motor 24, an evaporator 26 and an evaporator fan 28 driven by an evaporator fan motor 30. Air flow through the condenser 20 and the evaporator 26 are shown in FIG. 3 by arrows 31. Refrigerant is circulated through the compressor 16, condenser 20 and evaporator 26, which are connected by refrigerant tubes 32. The operation of the refrigerator 10 is controlled by a microprocessor, or programmable controller 40. The controller 40 is responsible for maintaining the temperature within the enclosure 12 by controlling the refrigeration unit 14. More specifically, the controller 40 regulates run times of the compressor motor 18, condenser fan motor 24 and evaporator fan motor 30. The controller 40 has a time measurement device, or internal clock, to measure elapsed time for a variety of conditions as discussed in more detail below.

As the refrigeration unit 14 operates, water vapor condenses on the evaporator 26 which results in the build-up of condensate, or frost and ice, on the evaporator 26. The build-up of frost and ice on the evaporator 26 results in diminished air flow through the evaporator 26 and a reduction in the ability of the refrigeration unit 14 to cool the air within the refrigerator 10. Accordingly, the controller 40 is also responsible for causing the refrigeration unit to enter a defrost operation to melt the ice. As is known in the art, the defrost operation entails stopping the cooling operation of the refrigeration unit 14 and individually controlling the compressor motor 18 and the fan motors 24, 30 in such a way that allows the evaporator 26 to warm and the ice to melt. Preferably, a defrost heater 42 is also provided on or adjacent the evaporator 26. The controller 40 turns on the defrost heater 42 during the defrost operation to expedite the melting of the ice. One skilled in the art will appreciate that use of the defrost heater 42 is optional.

In general, the controller 40 senses a build up of ice on the evaporator 26 coil by determining a temperature differential between air temperature in the enclosure 12 and refrigerant temperature in the evaporator 26. In other words, the amount of ice is extrapolated from heat transfer principles related to the transfer of heat from the air in the enclosure 12 to the refrigerant. The rate of heat transfer is dependent on three factors: surface area of the evaporator 26, a heat transfer coefficient and a temperature difference between the air and the refrigerant. For any one refrigerator, the surface area of the evaporator 26 is either in fact a constant or assumed to be a constant. However, as ice builds up on the evaporator 26, the heat transfer coefficient is reduced. This causes the temperature of the refrigerant in the evaporator to fall and the temperature difference between the air and the refrigerant to increase. Therefore, the temperature differential between the air and the refrigerant is indicative of ice build up. The temperature differential between the air and the refrigerant will herein be referred to as $\Delta t$.

The refrigerator 10 provides an air temperature sensor 44 for measuring an air temperature. The air temperature sensor 44 is preferably located in the vicinity of a return air passage where air passes from the enclosure 12 on its way to the evaporator 26. Most preferably, the air temperature sensor 44 is mounted near the evaporator fan 28, such as on a screen, or grill 46, covering the evaporator fan 28. Placing the air temperature sensor 44 in the return path of the air on its way to the evaporator 26 allows for an accurate measurement of the return air, indicated by arrow 48, which is the most preferred value in computing $\Delta t$. One skilled in the art, however, will appreciate that the air temperature sensor 44 can alternatively be placed in other locations within the refrigerator 10.

The air temperature sensor 44 is preferably an intelligent sensor which constructs an air temperature signal from the measured air temperature. Such an intelligent sensor is sold by Dallas Semiconductor Corp., 4401 TS Beltwood Pkwy, Dallas, Tex. 75244-3292 under the designation DS1821. The air temperature sensor 44 communicates with the controller 40 and transmits the air temperature signal to the controller 40. The air temperature sensor 44 is preferably configured to have a serial communication port connected to the microprocessor. The air temperature signal is output directly to the microprocessor as a digital value. The controller 40 is preferably provided with the air temperature signal so that air temperature is known by the controller 40 either continuously or within the period of a sampling rate of short duration.

The refrigerator 10 also provides a refrigerant temperature sensor 50 for measuring refrigerant temperature. The refrigerant temperature sensor 50 is preferably mounted, or clamped, on an evaporator 26 inlet tube 52, through which the refrigerant enters the evaporator 26. Placing the refrigerant temperature sensor 50 in this location allows for the accurate measurement of refrigerant temperature as the refrigerant enters the evaporator 26. This is the most preferred value in computing $\Delta t$. One skilled in the art, however, will appreciate that the refrigerant temperature sensor 50 can be mounted at other locations in or adjacent the evaporator 26. The refrigerant temperature sensor 50 discussed above is mounted externally on the refrigerant inlet tube 52. The refrigerant temperature sensor 50 can alternatively be mounted internal to the refrigerant inlet tube 52 so as to come in direct contact with the refrigerant. However, since mounting the refrigerant temperature sensor 50 externally is simple and cost effective, it is preferred.

Like the air temperature sensor, the refrigerant temperature sensor 50 is also preferably an intelligent sensor which constructs a refrigerant temperature signal from the measured refrigerant temperature. The same type of sensor as used for the air temperature sensor 44 will be satisfactory. Accordingly, the refrigerant temperature sensor 50 is preferably configured to have a serial communication port connected to the microprocessor. The refrigerant temperature signal is output directly to the microprocessor as a digital value. The controller 40 is preferably provided with the refrigerant temperature signal so that refrigerant temperature is known by the controller 40 either continuously or within the period of a sampling rate of short duration.

The refrigerator 10 is provided with a door 54 (FIG. 1) for providing access into the enclosure 12. As shown, the door 54 is a curved front panel made of glass supported by a frame. The illustrated door 54 is hinged along its top edge to the cabinet of the refrigerated device and pivots upwardly. However, this configuration is merely representative and any type of door known in the art, such as sliding doors on the rear of the refrigerator 10 or cabinet style doors, will work with equivalent results. The refrigerator 10 is provided with a door sensor 56, such as a switch, for providing a door open signal to the controller 40 when the door 54 is ajar. Should the door 54 be left ajar for a long period of time, for example 30 minutes, the controller 40 preferably activates an alarm 58 to audibly and/or visually alert a person that the door 54 has been left open.

The refrigerator 10 will also activate the alarm 58 should the enclosure 12 become too warm. This is known as a high temperature alarm. The controller 40 is responsible for determining if the enclosure 12 has become too warm by comparing the air temperature signal with a predetermined preferred operating temperature, or set point.

The refrigerator 10 is also provided with a display 59 for displaying various items of information useful to a person using the refrigerator 10 or a person servicing the refrigerator 10. The information to be displayed is provided to the display 59 by the controller 40. Information to be displayed includes, for example, the temperature in the enclosure 12 and door 54 position (open or closed). As will be discussed in greater detail below, the display 59 is also used to display fault information.

With additional reference to FIG. 4*a*, the operation of the refrigerator 10 will be described, with particular emphasis on the demand defrost features of the present invention. The controller 40 is programmed with a software routine to control the operation of the refrigerator 10, namely running the compressor motor 18, the evaporator fan motor 30, the condenser fan motor 24 and, if provided, the defrost heater 42. Electrical power to the compressor motor 18, the evaporator fan motor 30, the condenser fan motor 24 and the defrost heater 42 is preferably supplied from a power source 60 through miniature electromechanical relays 62. The relays 62 are excited by the controller 40 which is preferably programmed to switch the relays 62 near the zero crossing of the current flow. The intention is to extend the life of the relay 62 by minimizing relay contact erosion that normally occurs when the contacts are opened and closed when current level is high. Via a monitor circuit 64, the controller 40 monitors the line voltage and uses the voltage phase as a time base for exciting the relays 62. The controller 40 must compensate for the response time of the relay 62 and the current phase lag. Therefore, the relay 62 is activated 60° to 85° ahead of the current zero crossing. This corresponds to energizing the relay 62 at a voltage phase angle of 95° to 120°.

The refrigerator 10 is provided with a temperature set point which is the target temperature that is maintained in the enclosure 12. The temperature set point is programmed into the controller 40 and may optionally be adjusted using a temperature adjustment dial, as is well known in the art.

Figure 4A:
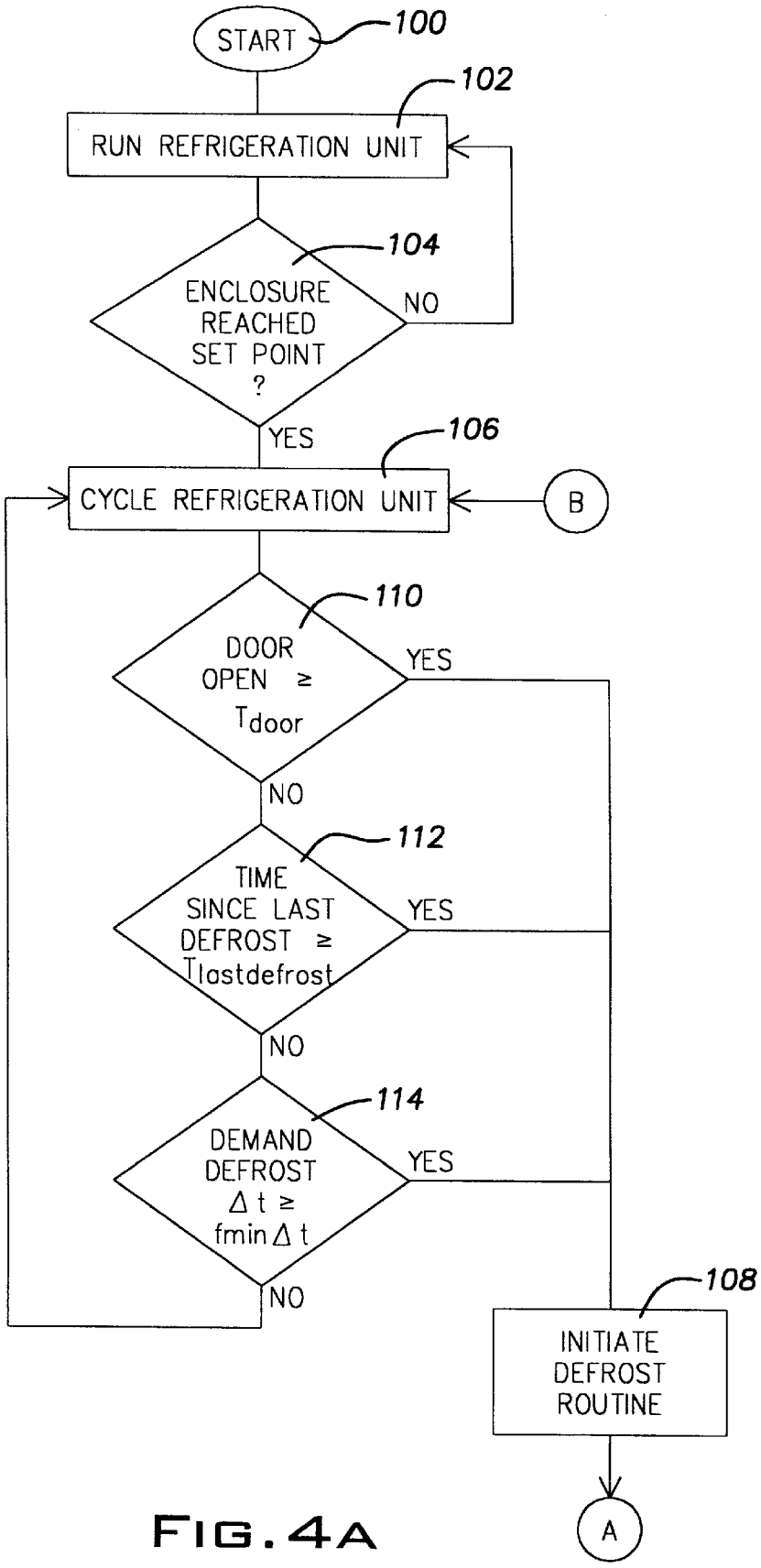
FIGS. 4*a* and 4*b* are flowcharts depicting the operation of a demand defrost scheme according to the present invention.

When the refrigerator 10 is initially turned on, preferably by supplying electrical power to the refrigerator 10, the controller 40 begins the software routine as indicated in FIG. 4*a* by reference number 100. The controller 40 runs the refrigeration unit 14 so as to cool the enclosure 12, as indicated by box 102. Running the refrigeration unit 14 includes circulating the refrigerant through the compressor 16, condenser 20 and evaporator 26 by switching on the compressor motor 18. Running the refrigeration unit 14 also includes circulating air from the surrounding atmosphere through the condenser 20 by switching on the condenser fan motor 24 to drive the condenser fan 22. Running the refrigeration unit 14 also includes circulating air from the enclosure 12 through the evaporator 26 by switching on the evaporator fan motor 30 to drive the evaporator fan 28. Time delays for starting or stopping either or both of the fan motors 24, 30 relative to the compressor motor 18 can be used to maximize the cooling efficiency of the refrigeration unit 14. The controller 40 monitors the air temperature signal and once the set point has been reached, decision box 104, the refrigeration unit 14 is run intermittently, or cycled, on an as needed basis to maintain the enclosure 12 at the set point, box 106.

During cycled operation of the refrigeration unit 14, the controller 40 monitors three conditions. If any of the conditions are met, a defrost routine will be initiated, box 108. As previously mentioned the defrost routine includes individually controlling, turning on or off, the compressor motor 18, fan motors 24, 30, and the defrost heater 42, if provided, to allow the evaporator to warm and the ice to melt.

The first condition is the door 54 status. As indicated above, the controller 40 is provided with the door open signal when the door 54 is ajar. If the door 54 is continually left opened for a time period greater or equal to a predetermined time, or $T_{door}$, the controller 40 will initiate the defrost routine as indicated by decision box 110. For most commercial refrigerators or freezers, $T_{door}$ is preferably about 30 minutes. Alternatively, the controller 40 can be programmed to monitor number of door 54 openings or aggregate door 54 open time during a specified time period. If the number of door 54 openings or aggregate door 54 open time exceeds a certain threshold, the controller 40 will initiate the defrost routine.

The second condition is elapsed time since a preceding defrost operation. After a defrost operation is completed, the controller 40 monitors the time elapsed. If the time elapsed since the preceding defrost operation equals or exceeds a programmed threshold, or $T_{lastdefrost}$, the controller 40 will initiate the defrost routine as indicated by decision box 112. For most commercial refrigerators or freezers, $T_{lastdefrost}$ is preferably about 72 hours.

The third condition is based on accumulation of ice on the evaporator 26 as indicated by the temperature difference between the air and the refrigerant, $\Delta t$. As will become more apparent from the discussion below, this condition for initiating defrost is based on the need for removing ice accumulation and will be referred to as demand defrost. As mentioned previously, $\Delta t$ is computed by the controller 40 by comparing the air temperature signal with the refrigerant temperature signal. If $\Delta t$ equals or exceeds a defrost threshold, demand defrost is desired and the controller 40 will initiate the defrost routine as indicated by decision box 114. The defrost threshold is the result of a function based on a smallest, or minimum, measured temperature difference $\Delta t$, from a previous refrigeration unit cooling cycle 106. Accordingly, the defrost threshold can be expressed as $f\min\Delta t$, where $\min\Delta t$ is the minimum temperature difference. The previous cycle during which $\min\Delta t$ is calculated is preferably understood to mean the $\min\Delta t$ reached at any point during the cycled cooling operation of the refrigeration unit occurring since the end of the most recent defrost routine. Under this definition, a new $\min\Delta t$ is established after each defrost routine. At least two less preferred meanings for the previous cycle are contemplated. The previous cycle during which $\min\Delta t$ is calculated is less preferably understood to mean the $\min\Delta t$ reached at any point during the operation of the refrigeration unit regardless of whether a defrost routine has occurred since the $\min\Delta t$ was reached. Under this definition, $\min\Delta t$ is remembered by the controller from one defrost routine to the next and is only revised if a smaller temperature differential occurs. The previous cycle during which $\min\Delta t$ is calculated is also less preferably understood to mean an adaptive response to each $\min\Delta t$ reached between each defrost routine.

Figure 5:
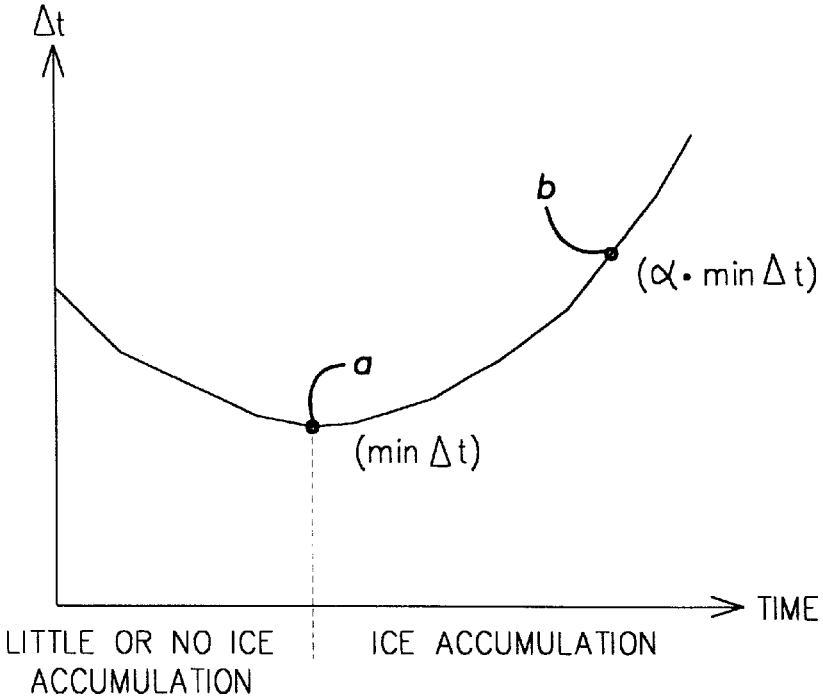
FIG. 5 is a graphical representation showing the basis for the demand defrost scheme according to the present invention.

With additional reference to FIG. 5, the determination of $\min\Delta t$ will be explained. FIG. 5 is a graphical representation of $\Delta t$ as time progresses during a cooling cycle of the refrigerator 10. As the refrigeration unit 14 operates, the air temperature in the enclosure 12 decreases. As a result, $\Delta t$ becomes smaller as time elapses. As long as the evaporator 26 remains free of ice or if only a small amount of ice has accumulated, $\Delta t$ will continue to decrease. However, as ice begins to form on the evaporator 26 in any significant quantity, the transfer of heat from the air to the refrigerant becomes less efficient and $\Delta t$ will start to increase. The point at which $\Delta t$ is the smallest is the minimum temperature difference between the air and the refrigerant, or $\min\Delta t$, as indicated by point a in FIG. 5.

The controller 40 is programmed to initiate the defrost routine when $\Delta t$ equals or exceeds a defrost threshold value derived from $\min\Delta t$. The function $f\min\Delta t$ is preferably $\min\Delta t$ multiplied by a coefficient $\alpha$ and can be expressed as $\alpha\cdot\min\Delta t$ as indicated by point b in FIG. 5. The coefficient $\alpha$ is a number based on the specific refrigerator being controlled and its cooling demands. Cooling demands are primarily based on the set point, the size of the enclosure 12, and the number and duration of door 54 openings. Accordingly, coefficient $\alpha$ can be a fixed number. Examples for coefficient $\alpha$ include 2, 2.5, 3, 3.25, 3.5, and 4. As an example, a typical refrigerator may have a $\min\Delta t$ of about 5° F. For the same refrigerator a $\Delta t$ of 15° F. may indicate an undesirable icing condition and represents the threshold to trigger a defrost routine. Therefore, in this example, the controller 40 is programmed with a coefficient $\alpha$ of 3.

Coefficient $\alpha$ can be a fixed number as described above, or, more preferably, coefficient $\alpha$ is a variable with a numerical value determined by the controller 40 to encourage defrosting the refrigerator 10 during periods of non-use. In other words, the controller 40 is programmed to relax the defrost threshold when the refrigerator 10 is not being used. The controller 40 uses door 54 openings as an indication of usage. If the door 54 has been closed for a lengthy period, for example for four hours, there is a strong indication that the refrigerator 10 is not in a period of usage. Therefore, it is desirable to take advantage of this opportunity to defrost the evaporator 26 when the cooling demands of the refrigerator 10 are low. With this in mind, the controller 40 is preferably programmed to have a normal operation coefficient $\beta$ and a low usage coefficient $\gamma$. During normal operation, when the door 54 is opened regularly, the controller 40 will initiate the defrost routine when the defrost threshold is based on fminΔt using coefficient β. During periods of non-use, the controller 40 will initiate the defrost routine when the defrost threshold is based on fminΔt using coefficient γ, where coefficient γ is less than coefficient β.

By using a variable coefficient to relax the defrost threshold during periods of non-use, the refrigerator 10 is made more energy efficient and more able to maintain the temperature of the enclosure 12. For example, for the refrigerator having a minΔt of 5° F. and a Δt of 15° F. that indicates an undesirable icing condition, the normal operation coefficient β is 3 and the defrost threshold is 15° F. If the low usage coefficient γ is programmed to be 2, then the defrost threshold will be reduced to 10° F. Having a lower defrost threshold means that less ice is required to trigger a Δt that meets or exceeds the defrost threshold. It follows that the refrigerator 10 is more likely to enter defrost during periods of non-use, when the cooling demands of the refrigerator 10 are low. This way, the evaporator 26 will be more likely to be free of ice when normal use is made of the refrigerator 10. This is advantageous since it is less desirable to initiate a defrost routine during periods of normal or heavy use. During periods of normal or heavy use the temperature inside the enclosure 12 is more difficult to maintain due to ice reducing the effectiveness of the heat transfer and heat loss through the door 54. If defrost is initiated during usage, the temperature in the enclosure 12 is even harder to maintain because the refrigeration unit 14 does not enter cooling cycles during the defrost period. Even with these considerations in mind, ice will accumulate rapidly during periods of heavy use and if Δt does exceed the defrost threshold for normal operation, defrosting is required and the defrost routine will be initiated.

It has been found that the use of coefficient α, or coefficients β and γ, in fminΔt is effective to establish the defrost threshold. One skilled in the art, however, will appreciate that other computations can be used for fminΔt, rather than a coefficient.

Figure 4B:
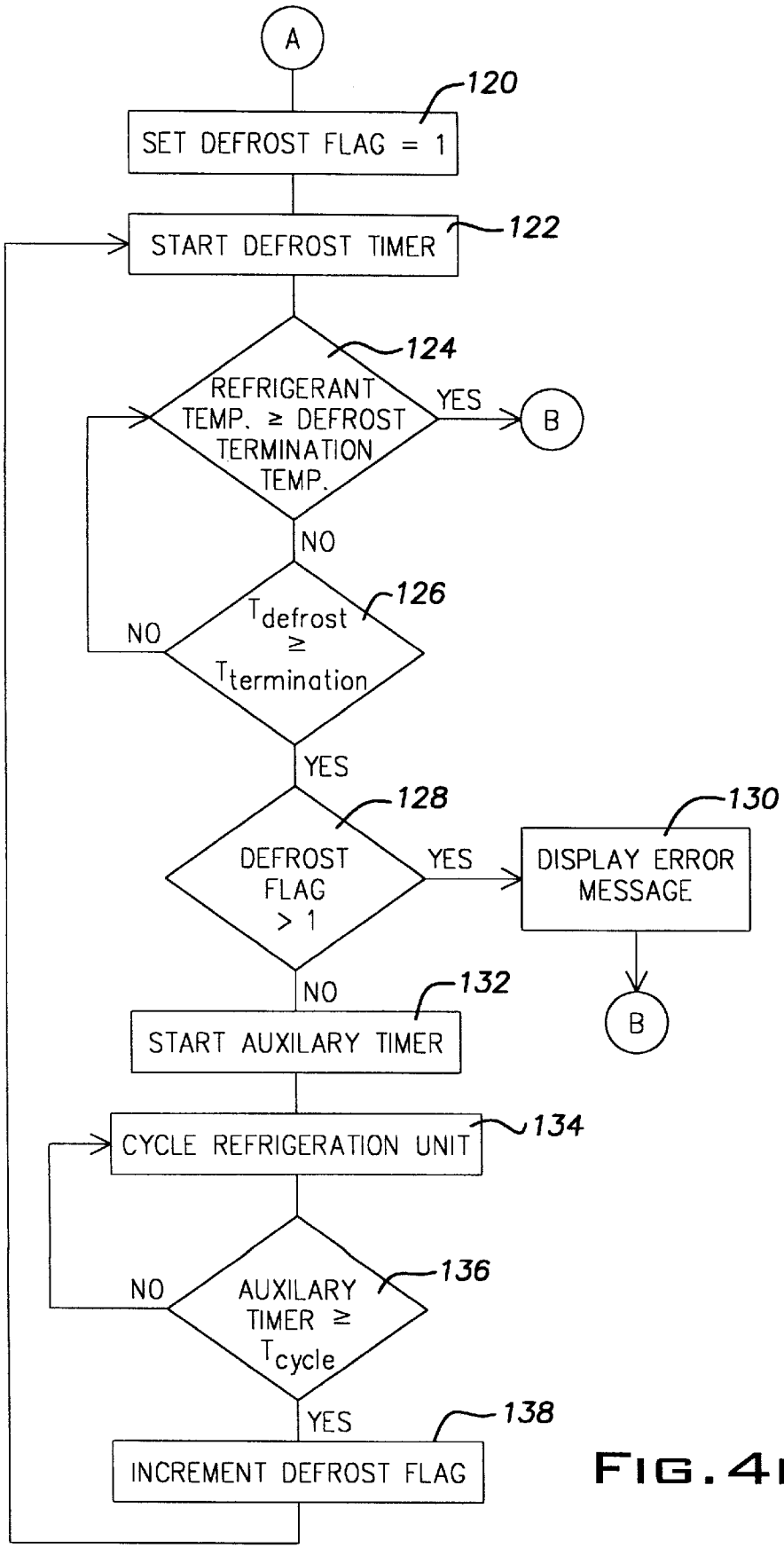

FIG. 4*b* is a flowchart of the defrost routine. When the defrost routine is initiated, the controller 40 is programmed to enter a first defrost operation for melting ice from the evaporator. Termination of the first defrost operation is dependent upon two conditions. Generally, the first condition is refrigerant temperature and the second condition is elapsed time. If the refrigerant temperature reaches or exceeds a predetermined value during the first defrost operation, the refrigerator 10 is returned to normal cycled operation, box 106. If a certain time elapses before the refrigerant temperature reaches the predetermined value, the first defrost operation is terminated based on time. If the first defrost operation is terminated based on time, the controller 40 is programmed to initiate a cooling cycle for a predetermined period of time and then defrost the evaporator 26 again, or second defrost operation. The conditions for terminating the second defrost operation are preferably the same as the second defrost operation. If the second defrost operation terminates based on refrigerant temperature, normal cycled cooling will proceed. However, if the second defrost operation terminates based on time, there is an indication that a problem exists and the controller 40 will display an error message on the display 59 before returning the refrigerator 10 to normal cycled cooling.

As one skilled in the art will appreciate, the foregoing defrost routine can be implemented in a number of equivalent ways. The following is a description of a preferred embodiment for implementing the defrost routine. The controller 40 is programmed to remember that a first defrost operation has been initiated. Software flags are typically used to remember and recall information of this type by programmable apparatus. Accordingly, the controller 40 sets a software flag, hereinafter a defrost flag, to indicate that the first defrost operation has been initiated. For example, the defrost flag can be set to 1 as indicated by box 120.

The controller 40 is also programmed to remember how much time has elapsed since the start of the first defrost operation, or $T_{defrost}$. Timers are typically used to remember and recall information of this type by programmable apparatus. Accordingly, the controller 40 starts a defrost timer to keep track of $T_{defrost}$, as indicated by box 122.

The temperature of the refrigerant is indicative of whether the ice has been cleared from the evaporator 26. Therefore, the first defrost operation is terminated if the refrigerant temperature equals or exceeds a defrost termination temperature, as indicated by decision box 124. Should the temperature of the refrigerant reach or exceed the defrost termination temperature, the controller 40 is programmed to return the refrigeration unit 14 to normal operation by cycling the refrigeration unit 14 as indicated by box 106. For a typical commercial refrigerator the defrost termination temperature is about 50° F. and for a typical commercial freezer the defrost termination temperature is about 38° F.

If the defrost termination temperature is not reached in a certain time period, or termination time, $T_{termination}$, the controller 40 will terminate the first defrost operation but the refrigeration unit 14 will not be returned to normal cycled operation. The controller 40 implements time based termination by comparing $T_{defrost}$ and $T_{termination}$. If $T_{defrost}$ is greater or equal to $T_{termination}$, the controller 40 will terminate the first defrost operation as indicated by decision box 126. $T_{termination}$ is preferably about 45 minutes for commercial refrigeration devices.

Should the first defrost operation be terminated based on time, the controller 40 is programmed to conduct the second defrost operation. The controller 40 is programmed to check the defrost flag. If the defrost flag is the same as its initial setting, decision box 128, then the controller 40 will proceed with the defrost routine. However, if the defrost flag has been incremented, discussed below, the controller 40 exits the defrost routine by first displaying a defrost error message to the display 59, as indicated by box 130, and then returns the refrigerator 10 to normal cycled operation, box 106. Alternatively, the controller can be programmed to run under other parameters in a fault condition.

If the second defrost operation is to proceed, the controller 40 will first begin an auxiliary timer to measure elapsed time since the end of the first defrost operation, indicated by box 132. Next, the controller 40 will cool the enclosure 12 by cycling the refrigeration unit 14 as indicated by box 134. The refrigeration unit 14 will be cycled for a predetermined period of time, $T_{cycle}$. More specifically, if the auxiliary timer meets or exceeds $T_{cycle}$, the cooling cycles will be terminated as indicated by decision box 136. $T_{cycle}$ is preferably about 2.9 hours. When the auxiliary timer meets or exceeds $T_{cycle}$, the controller 40 will increment the defrost flag, box 138, to indicate that the second defrost operation has begun. Next, the evaporator 26 is defrosted. The controller 40 is preferably programmed to terminate the second defrost operation on the same conditions as the first defrost operation. However, one skilled in the art will appreciate that a second defrost termination temperature and a second $T_{termination}$ can be programmed into the controller for terminating the second defrost operation. Accordingly, the defrost timer is started as indicated in box 122. If the refrigerant temperature meets of exceeds the defrost termination temperature, the refrigerator 10 will be returned to normal cycled operation as indicated by decision box 124. If the defrost timer meets or exceeds $T_{termination}$ before the defrost termination temperature is reached, then the second defrost operation will be terminated based on time as indicated by decision box 126. If the second defrost operation is terminated based on time, the controller 40 checks to see how many defrost operations have taken place by determining if the defrost flag has been incremented as indicated in decision box 128. At this point in the processing of the second defrost operation, the defrost flag has been incremented. Accordingly, the controller 40 will display an error message on the display 59 as indicated in box 130. Next, the refrigerator 10 will be returned to normal cycled operation as indicated in box 106 or as otherwise programmed.

In addition to the foregoing programming, the controller 40 is programmed with several failsafes. The programming contains a cyclic redundancy check (CRC) to ensure commands and communications are accurate. The controller 40 also contains a watchdog timer for resetting the program if the program becomes stuck in a loop.

The controller 40 is also programmed to address failure of the refrigerant temperature sensor 50 and/or the air temperature sensor 44. If one or both of these sensors 44, 50 fail, an alert will be displayed on the display 59. If the controller 40 fails to receive the refrigerant temperature signal from the refrigerant temperature sensor 50, the controller 40 will continue to cool the enclosure 12 at the set point by cycling the refrigeration unit 14 and monitoring the air temperature signal. Since the defrost routine is dependent upon the refrigerant temperature, the defrost scheme described herein will be lost if the refrigerant temperature sensor 50 fails. However, even if the refrigerant temperature sensor 50 fails, the controller 40 will defrost the evaporator 26 periodically. For example, the controller 40 will cycle the refrigeration unit 14 for eight hours and then defrost the evaporator 26 for a predetermined length of time.

If the controller 40 fails to receive the air temperature signal from the air temperature sensor 44, the controller 40 will continue to cool the enclosure 12 by cycling the refrigeration unit 14. During this cycling, the controller 40 will run the refrigeration unit 14 until the refrigerant temperature falls to a predetermined point, such as −40° F. If the refrigerant temperature sensor 50 fails, the controller 40 will defrost the evaporator 26 periodically. For example, the controller 40 will cycle the refrigeration unit 14 for eight hours and then defrost the evaporator 26 for a predetermined length of timer.

If both the refrigerant temperature sensor 50 and the air temperature sensor 44 fail, the controller 40 is programmed to run the refrigeration unit 14 continuously with periodic interruptions to defrost the evaporator 26 for a predetermined length of time. For example, the refrigeration unit 14 will be run for eight hours and then defrosted.

Although particular embodiments of the invention have been described in detail, it is understood that the invention is not limited correspondingly in scope, but includes all changes and modifications coming within the spirit and terms of the claims appended hereto.

What is claimed is:

1. A refrigerated device including a cooled enclosure and an evaporator, the evaporator having refrigerant circulated therethrough, comprising:

an air temperature sensor, the air temperature sensor being adapted to generate an air temperature signal indicative of air temperature within the enclosure;

a refrigerant temperature sensor, the refrigerant temperature sensor being adapted to generate a refrigerant temperature signal indicative of refrigerant temperature; and a programmable controller, the programmable controller being adapted to compare the air temperature signal and the refrigerant temperature signal to calculate a difference between the air temperature and the refrigerant temperature, wherein the controller initiates a defrost routine for removing condensate from the evaporator if the difference between the air temperature and the refrigerant temperature is greater or equal to a defrost threshold, the defrost threshold being determined by a function of a minimum difference between the air temperature and the refrigerant temperature.

2. The refrigerated device according to claim 1, wherein the air temperature sensor is located in a path of air entering the evaporator.

3. The refrigerated device according to claim 1, wherein the refrigerant temperature sensor is mounted on a refrigerant inlet tube through which refrigerant enters the evaporator.

4. The refrigerated device according to claim 1, wherein the minimum temperature difference is from a previous cooling cycle.

5. The refrigerated device according to claim 1, wherein the defrost threshold is determined by the multiplication of the minimum temperature difference by a coefficient.

6. The refrigerated device according to claim 5, wherein the coefficient is variable and the controller reduces the coefficient during periods of non-use of the refrigerated device.

7. The refrigerated device according to claim 1, wherein the defrost routine has a first defrost operation for removing condensate from the evaporator and the controller is adapted to terminate the first defrost operation if the refrigerant temperature meets or exceeds a first defrost termination temperature or if an elapsed time for the first defrost operation meets or exceeds a first defrost termination time, whichever occurs first.

8. The refrigerated device according to claim 7, wherein the controller is adapted to initiate a cooling operation for a predetermined period of time if the first defrost operation is terminated based on elapsed time, the cooling operation being followed by a second defrost operation for removing condensate from the evaporator and the controller is adapted to terminate the second defrost operation if the refrigerant temperature meets or exceeds a second defrost termination temperature or if an elapsed time for the second defrost operation meets or exceeds a second defrost termination time, whichever occurs first.

9. The refrigerated device according to claim 8, wherein the controller is adapted to display an error message on a display if the second defrost operation is terminated based on elapsed time.

10. A method of defrosting a refrigerated device on demand, the refrigerated device including a cooled enclosure and an evaporator, the evaporator having refrigerant circulated therethrough, comprising:

sensing an air temperature and generating an air temperature signal indicative of air temperature within the enclosure;

sensing a refrigerant temperature and generating a refrigerant temperature signal indicative of refrigerant temperature;

comparing the air temperature signal and the refrigerant temperature signal to calculate a difference between the air temperature and the refrigerant temperature; and initiating a defrost routine for removing condensate from the evaporator if the difference between the air temperature and the refrigerant temperature is greater or equal to a defrost threshold, the defrost threshold being determined by a function of a minimum difference between the air temperature and the refrigerant temperature.

11. The method of defrosting a refrigerated device according to claim 10, wherein the air temperature is sensed in a path of air entering the evaporator.

12. The method of defrosting a refrigerated device according to claim 10, wherein the refrigerant temperature is sensed where the refrigerant enters the evaporator.

13. The method of defrosting a refrigerated device according to claim 10, wherein the minimum temperature difference is from a previous cooling cycle.

14. The method of defrosting a refrigerated device according to claim 10, wherein the defrost threshold is determined by the multiplication of the minimum temperature difference by a coefficient.

15. The method of defrosting a refrigerated device according to claim 14, further comprising the step of reducing the coefficient during periods of non-use of the refrigerated device.

16. The method of defrosting a refrigerated device according to claim 10, wherein the defrost routine includes the steps of:

initiating a first defrost operation for removing condensate from the evaporator; and terminating the first defrost operation if the refrigerant temperature meets or exceeds a first defrost termination temperature or if an elapsed time for the first defrost operation meets or exceeds a first defrost termination time, whichever occurs first.

17. The method of defrosting a refrigerated device according to claim 16, wherein the defrost routine further includes the step of:

initiating a cooling operation for a predetermined period of time if the first defrost operation is terminated based on elapsed time, the cooling operation being followed by a second defrost operation for removing condensate from the evaporator, the second defrost operation being terminated if the refrigerant temperature meets or exceeds a second defrost termination temperature or if an elapsed time for the second defrost operation meets or exceeds a second defrost termination time, whichever occurs first.

18. The method of defrosting a refrigerated device according to claim 17, wherein the defrost routine further includes the step of displaying an error message if the second defrost operation is terminated based on elapsed time.

19. A method of detecting formation of condensate on an evaporator having refrigerant circulated therethrough and used in the cooling of an enclosure, comprising the steps of:

sensing an air temperature in the enclosure;

sensing a refrigerant temperature;

comparing the air temperature and the refrigerant temperature to calculate a temperature differential, the temperature differential being an indication of the formation of condensate on the evaporator if the temperature differential is greater or equal to a defrost threshold, the defrost threshold being determined by a function of a minimum temperature differential between the air temperature and the refrigerant temperature.

20. The method of detecting formation of condensate according to claim 19, wherein the air temperature is sensed in a path of air entering the evaporator.

21. The method of detecting formation of condensate according to claim 19, wherein the refrigerant temperature is sensed where the refrigerant enters the evaporator.

22. The method of detecting formation of condensate according to claim 19, wherein the minimum temperature differential is from a previous cooling cycle.

23. The method of detecting formation of condensate according to claim 19, wherein the defrost threshold is determined by the multiplication of the minimum temperature differential by a coefficient.

24. The method of detecting formation of condensate according to claim 23, further comprising the step of varying the coefficient based on usage of a refrigerated device associated with the evaporator.

* * * * *